US006884155B2

(12) United States Patent
Sung et al.

(10) Patent No.: US 6,884,155 B2
(45) Date of Patent: Apr. 26, 2005

(54) DIAMOND GRID CMP PAD DRESSER

(75) Inventors: Chien-Min Sung, Tansui (TW); Frank Lin, Tansui (TW)

(73) Assignee: Kinik, Ying-Ku (TW)

( * ) Notice: Subject to any disclaimer, the term of this patent is extended or adjusted under 35 U.S.C. 154(b) by 21 days.

(21) Appl. No.: 10/109,531

(22) Filed: Mar. 27, 2002

(65) Prior Publication Data

US 2002/0173234 A1 Nov. 21, 2002

Related U.S. Application Data

(63) Continuation-in-part of application No. 09/558,582, filed on Apr. 26, 2000, now Pat. No. 6,368,198, which is a continuation-in-part of application No. 09/447,620, filed on Nov. 22, 1999, now abandoned.

(51) Int. Cl.[7] ..... B24B 21/18

(52) U.S. Cl. ..... 451/443; 451/285; 451/56

(58) Field of Search ..... 451/41, 56, 285, 451/287, 443, 444, 526, 539, 540, 548

(56) References Cited

U.S. PATENT DOCUMENTS

| | | | |
|---|---|---|---|
| 2,268,663 | A | 1/1942 | Kuzmick |
| 2,612,348 | A | 9/1952 | Catallo |
| 2,811,960 | A | 11/1957 | Fessel |
| 2,867,086 | A | 1/1959 | Haley |

(Continued)

FOREIGN PATENT DOCUMENTS

| | | | |
|---|---|---|---|
| JP | 10128654 | A | 5/1998 |
| JP | 10180618 | A | 7/1998 |
| JP | 11048122 | A | 2/1999 |
| JP | 11077536 | A | 3/1999 |

*Primary Examiner*—Lee D. Wilson
*Assistant Examiner*—Anthony Ojini
(74) *Attorney, Agent, or Firm*—Thorpe North & Western, LLP

(57) ABSTRACT

The present invention discloses a CMP pad dresser which has a plurality of uniformly spaced abrasive particles protruding therefrom. The abrasive particles are super hard materials, and are typically diamond, polycrystalline diamond (PCD), cubic boron nitride (cBN), or polycrystalline cubic boron nitride(PcBN). The abrasive particles are brazed to a substrate which may be then coated with an additional anti-corrosive layer. The anti-corrosive layer is usually a diamond or diamond-like carbon which is coated over the surface of the disk to prevent erosion of the brazing alloy by the chemical slurry used in conjunction with the CMP pad. This immunity to chemical attack allows the CMP pad dresser to dress the pad while it is polishing a workpiece. In addition to even spacing on the substrate, the abrasive particles extend for a uniform distance away from the substrate, allowing for even grooming or dressing of a CMP pad both in vertical and horizontal directions. A method of producing such a CMP pad dresser is also disclosed.

36 Claims, 4 Drawing Sheets

U.S. PATENT DOCUMENTS

| | | | | | |
|---|---|---|---|---|---|
| 3,127,715 | A | | 4/1964 | Christensen | |
| 3,276,852 | A | | 10/1966 | Lemelson | |
| 4,680,199 | A | | 7/1987 | Vontell et al. | |
| 4,925,457 | A | | 5/1990 | deKok et al. | |
| 4,949,511 | A | | 8/1990 | Endo et al. | |
| 4,968,326 | A | | 11/1990 | Wiand | |
| 5,049,165 | A | | 9/1991 | Tselesin | |
| 5,092,910 | A | | 3/1992 | deKok et al. | |
| 5,190,568 | A | | 3/1993 | Tselesin | |
| 5,246,884 | A | | 9/1993 | Jaso | |
| 5,271,547 | A | * | 12/1993 | Carlson | 228/122.1 |
| 5,380,390 | A | | 1/1995 | Tselesin | |
| 5,453,106 | A | | 9/1995 | Roberts | |
| 5,527,424 | A | | 6/1996 | Mullins | |
| 5,609,286 | A | * | 3/1997 | Anthon | 228/56.3 |
| 5,746,931 | A | | 5/1998 | Graebner | |
| 5,816,891 | A | | 10/1998 | Woo | |
| 5,833,519 | A | | 11/1998 | Moore | |
| 5,902,173 | A | | 5/1999 | Tanaka | |
| 5,916,011 | A | | 6/1999 | Kim | |
| 5,921,856 | A | * | 7/1999 | Zimmer | 451/539 |
| 5,961,373 | A | | 10/1999 | Lai | |
| 6,106,382 | A | * | 8/2000 | Sakaguchi | 451/443 |
| 6,123,612 | A | * | 9/2000 | Goers | 451/540 |
| 6,190,240 | B1 | * | 2/2001 | Kinoshita et al. | 451/56 |
| 6,213,856 | B1 | * | 4/2001 | Cho et al. | 451/443 |
| 6,286,498 | B1 | | 9/2001 | Sung | |

* cited by examiner

DIAMOND GRID CMP PAD DRESSER

PRIORITY DATA

This patent application is a continuation-in-part of U.S. patent application Ser. No. 09/558,582 filed Apr. 26, 2000 now U.S. Pat. No. 6,368,198, which is a continuation-in-part of U.S. patent application Ser. No. 09/447,620 filed Nov. 22, 1999, now abandoned.

FIELD OF THE INVENTION

The present invention relates generally to a device and methods for dressing or conditioning a chemical mechanical polishing (CMP) pad. Accordingly, the present invention involves the chemical and material science fields.

BACKGROUND OF THE INVENTION

Many industries are now using a chemical mechanical process (CMP) for polishing certain work pieces. Particularly, the computer manufacturing industry has begun to rely heavily on CMP processes for polishing wafers of ceramics, silicon, glass, quartz, and metals thereof. Such polishing processes generally entail applying the wafer against a rotating pad made from a durable organic substance such as polyurethane. To the pad, is added a chemical slurry containing a chemical capable of breaking down the wafer substance, and an amount of abrasive particles which act to physically erode the wafer surface. The slurry is continually added to the spinning CMP pad, and the dual chemical and mechanical forces exerted on the wafer cause it to be polished in a desired manner.

Of particular importance to the quality of polishing achieved, is the distribution of the abrasive particles throughout the pad. The top of the pad holds the particles, usually by a mechanism such as fibers, or small pores, which provide a friction force sufficient to prevent the particles from being thrown off of the pad due to the centrifugal force exerted by the pad's spinning motion. Therefore, it is important to keep the top of the pad as flexible as possible, and to keep the fibers as erect as possible, or to assure that there are an abundance of open and pores available to receive new abrasive particles.

A problem with maintaining the top of the pad is caused by an accumulation of polishing debris coming from the work piece, abrasive slurry, and dressing disk. This accumulation causes a "glazing" or hardening of the top of the pad, and mats the fibers down, thus making the pad less able to hold the abrasive particles of the slurry, and significantly decreasing the pad's overall polishing performance. Further, with many pads, the pores used to hold the slurry, become clogged, and the overall asperity of the pad's polishing surface becomes depressed and matted. Therefore, attempts have been made to revive the top of the pad by "combing" or "cutting" it with various devices. This process has come to be known as "dressing" or "conditioning" the CMP pad. Many types of devices and processes have been used for this purpose. One such device is a disk with a plurality of super hard crystalline particles, such as diamond particles attached to a surface, or substrate thereof.

Unfortunately, such abrasive disks made by conventional methods exhibit several problems. First, abrasive particles may dislodge from the substrate of the disk and become caught in the CMP pad fibers. This leads to scratching and ruin of the work piece being polished. Second, the production methods of the past tend to produce disks having abrasive particles that are clustered in unevenly spaced groups on the surface of the substrate. The resultant non-uniform spacing between particles causes some portions of the CMP pad to be overdressed which creates wear marks, while others are underdressed which creates glazing layers. Third, the abrasive particles of these disks do not extend to a uniform height above the substrate surface of the disk. This non-uniformity in height creates additional uneven dressing of the CMP pad, because many particles from the dresser may not touch the pad. Finally, CMP pad fibers often depress upon contact with the initial leading edge of the dresser. This depression causes the remaining abrasive particles on the pad dresser to skip over the pad fibers thereby causing the pad to be unevenly dressed.

Two factors tend to cause the abrasive particles to dislodge from the pad dresser disks of the prior art. First, dislodging often occurs due to the inferior method by which the abrasive particles have been attached. Abrasive particles held to the substrate only by electroplated nickel or other overlay material are secured only by weak mechanical forces and not by any form of chemical bonding. Hence, these particles become easily dislodged upon exposure to strong mechanical forces such as friction. Furthermore, this dislodgement process is facilitated by the chemical attack on the electroplating material which is presented by the chemical slurry.

In contrast, when the abrasive particles are brazed onto the substrate, a chemical bond holds the particles more firmly. However, the acids of the chemical slurry quickly weaken the braze-particle bonds and dislodge the abrasive particles under the friction of pad dressing. Therefore, to minimize the exposure of the braze to the chemicals and extend the useful life of the pad dresser, the polishing processes must be halted while dressing occurs. The resultant sequence of alternating polishing and then dressing wastes time, and is inefficient.

Warping of the pad dresser working surface during the brazing process also often causes abrasive particles to dislodge. During the brazing process the pad dresser must be exposed to very high temperatures. Exposure to this extreme heat can cause the working surface of the pad dresser to warp, thus compromising the smoothness and planarity of the pad dresser's working surface. As a result, the braze portion of the working surface will be rough, having high and low spots. Such spots are undesirable, as they may cause the braze to begin flaking off, and making micro-scratches on the polished surface of the work piece. Further, such unevenness may cause issues with further processing of the dresser, and abrasive particle retention.

In view of the foregoing, a CMP pad dresser that is constructed and configured to achieve optimal dressing results, with maximized efficiency and lifespan continues to be sought through ongoing research and development efforts.

SUMMARY OF THE INVENTION

Accordingly, the present invention encompasses a CMP pad dresser which has a plurality of abrasive particles each coupled to a substrate member and held at specific locations in accordance with a predetermined pattern. Generally, the particles are of a super hard substance such as diamond, or cubic boron nitride (cBN), in either the single crystal or polycrystalline form.

In one method of forming the CMP pad dresser of the present invention, a brazing alloy is formed into a flexible sheet or roll. In one aspect of the invention, the brazing alloy may be provided as a rolled continuous film or layer of amorphous braze alloy. Such alloy contains no powder or binder, but rather is simply a homogenous braze composition, and has been found to be advantageous for use in the present invention, as it contains no eutectic phases that melt incongruently when heated.

The abrasive particles are then placed at specific locations on the sheet of brazing alloy in accordance with a predetermined pattern by use of a template that contains a plurality of evenly spaced apertures. The apertures of the template are larger than the size of one abrasive particle or "grit," but smaller than the size of two. Once all the apertures have been filled with abrasive particles, any excess abrasive particles are removed, and the abrasive particles are pressed into the brazing alloy sheet to embed them therein, by using a generally flat surface such as a steel plate. Alternatively, rather than pressing the particles into the brazing alloy sheet, they may be held in place by a tacky substance, or adhesive, such as a glue, or other polymeric resin. The template is then removed and brazing alloy containing the abrasive particles is placed on or affixed to a substrate with an adhesive, for example acrylic glue. Finally, the whole assembly is brazed in a vacuum furnace to complete the brazing process and firmly fix the abrasive particles to the substrate. In one aspect of the invention, the flexible sheet of brazing alloy may also be affixed to the substrate prior to introduction of the abrasive particles.

In an alternative embodiment, the abrasive particles may be affixed to a transfer sheet and then transferred to the brazing alloy. In one aspect of this embodiment, the transfer sheet can be made of metal or plastic, and may be flexible or rigid. Preferably, the transfer sheet is made of transparent plastic such that the transfer of superabrasive particles can be easily monitored. The affixing of superabrasive particles to the transfer plate or film can be facilitated by coating the transfer sheet with a thin layer of adhesive. The template is then used to distribute the abrasive particles onto the transfer sheet in the desired predetermined pattern. The transfer sheet having abrasive particles adhered thereto on one side is then pressed against the brazing alloy. The abrasive particles are transferred to the brazing alloy by either embedding therein, or by adhering to an adhesive that is coated on the surface thereof. The adhesive coated on the brazing alloy adheres the abrasive particles more strongly than the adhesive coated on the transfer sheet, and thus allows the particles to be transferred thereto. Notably, in each of the above-recited processes, the brazing alloy may be presented as either a sheet, or a punched out layer that In yet another alternative embodiment, the abrasive particles may be affixed directly to a substrate with an acrylic glue, or other adhesive using the template as described above. Next, the brazing alloy particles are showered, pressed, or otherwise disposed around the abrasive particles on the substrate. For example, the brazing alloy particles may be suspended in a binder to form a slurry, and the slurry may be sprayed onto the substrate. Finally, the whole assembly is heated in a vacuum furnace to complete the brazing process and firmly affix the abrasive particles to the substrate. Notably, when the brazing alloy slurry is used, it may be sprayed onto a clean substrate first, allowed to dry, and then abrasive particles may be added using any of the above-recited methods, such as the adhesive and transfer sheet. Subsequently, the assembly is subjected to final heat processing to form the finished CMP pad dresser product.

Furthermore, after heating the assembly of brazing alloy and abrasive particles, a layer of overlay material may be affixed to the working surface of the brazing alloy to create a smooth working surface. Because of the molten state and surface tension that the brazing alloy endures during the heating process, the finally formed working surface thereof may be quite rough, containing many jagged points that are easily flaked off during a dressing process. These brazing flakes may then remain in the CMP pad and cause micro-scratching on the polished work piece. The addition of the overlay material imparts a very smooth and planar working surface to the CMP pad dresser, and thus reduces or eliminates the jagged points with the disadvantages attendant thereto.

The overlay material has a predetermined thickness, so as not to interfere with the polishing capabilities of the abrasive particles. In addition, the overlay material generally comprises any one of many metallic substances, such as nickel, tungsten, cobalt, chromium, or a zirconium nickel alloy. The overlay material may be applied by several methods, but in certain aspects, may be applied by either electroplating or physical vapor deposition (PVD) processes.

Following the brazing process, a thin coating of optional anti-corrosive material may also be applied to the CMP pad dresser. Addition of the anti-corrosive material effectively "seals" the working surface of the CMP pad dresser. Thereby protecting the abrasive particles, the brazing alloy, and/or the overlay material from chemical attack by the chemicals found in the abrasive slurry, especially those slurries containing acids. The anti-corrosive material generally includes a super abrasive material, such as diamond-like carbon, or amorphous diamond. Similar to the overlay material, the anti-corrosive layer may have a predetermined thickness, so as effectively seal the working surface of the CMP pad dresser without interfere with the polishing abilities of the abrasive particles.

The overlay material provides a further benefit when the anti-corrosive layer is included in the CMP pad dresser. Specifically, the smooth planar working surface of the overlay material has been found to create much stronger bonds with the anti-corrosive layer because of its evenness. As such, the life of the anti-corrosive layer is extended as the layer wears evenly and does not flake or drop off by having portions become separated from the dresser.

Using the methods described above, a CMP pad dresser exhibiting considerable advantages may be created. For example, the working surface of the CMP pad dresser is rendered less susceptible to chemical degradation and its susceptibility to abrasive particle dislodgement is reduced. Therefore, the CMP pad dresser is able to continually dress the CMP pad, even during a polishing act (i.e. "in-situ"), because the agent binding the abrasive particles to the substrate is protected from chemical degradation. Such protection may also be provided by the overlay, as its composition is also less susceptible to acidic degradation than the brazing alloy.

Other dressing performance advantages may be obtained by employing a specific pattern or design of abrasive particles on the dresser. As indicated above, the use of a template allows the positioning or placement of abrasive particles, each at specific locations in accordance with a predetermined pattern. In one aspect, such patterns may be designed to present specific gaps or configurations that enhance the grooming of the pad. For example, the working surface of the CMP pad dresser may be configured to facilitate the rising of the CMP pad under an interior, or central portion of the dresser, rather than only along an outside or "leading edge" thereof. Such additional rising allows the dresser to more effectively cut into and groom the pad.

Use of the template also provides the ability to uniformly space the abrasive particles on the substrate. Uniform spacing of the abrasive particles upon the substrate also allows for a more even dressing of the pad across its surface. Additionally, by using a template with uniformly sized apertures, a uniform size of each abrasive particle is ensured. Finally, using a flat surface to press the abrasive particles into the substrate creates a uniform height of the abrasive particles protruding above the substrate surface. This uniform height of abrasive particles ensures cutting, or dressing of the CMP pad to a uniform depth. Alternatively, the use of a brazing alloy in a sheet or cut out with an even surface, in connection with uniformly sized abrasive particles that are adhered thereto, allows the creation of a uniform height between the abrasive particles.

The above-recited features and advantages of the invention will become apparent from a consideration of the following detailed description presented in connection with the accompanying drawings.

DETAILED DESCRIPTION OF THE INVENTION

Figure 1:
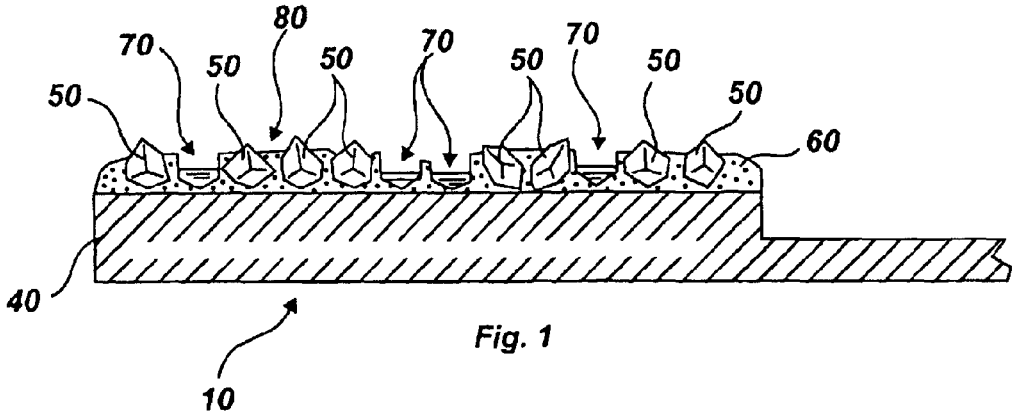
FIG. 1 is a side view of a prior art CMP pad dresser employing an electroplating method for fixing the abrasive particles to the disk substrate in accordance with one embodiment of the present invention.

Before the present CMP pad dresser and accompanying methods of use and manufacture are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," and, "the" include plural referents unless the context clearly dictates otherwise. Thus, for example, reference to an "abrasive particle" or a "grit" includes reference to one or more of such abrasive particles or grits.

Definitions

In describing and claiming the present invention, the following terminology will be used in accordance with the definitions set forth below.

As used herein, "abrasive particle," or "grit," or similar phrases mean any super hard crystalline, or polycrystalline substance, or mixture of substances and include but is not limited to diamond, polycrystalline diamond (PCD), cubic boron nitride, and polycrystalline cubic boron nitride (PCBN). Further, the terms "abrasive particle," "grit," "diamond," "polycrystalline diamond (PCD)," "cubic boron nitride," and "polycrystalline cubic boron nitride, (PCBN)," may be used interchangeably.

As used herein, "substrate" means the base portion of a CMP dresser having a surface on which the abrasive particles may be affixed. The base portion may be any shape, thickness, or material, and includes but is not limited to metals, alloys, ceramics, and mixtures thereof.

As used herein, "working surface" means the surface of a CMP pad dresser that, during operation, faces toward, or comes in contact with a CMP pad.

As used herein, "leading edge" means the edge of a CMP pad dresser that is a frontal edge based on the direction that the CMP pad is moving, or the direction that the pad is moving, or both. Notably, in some aspects, the leading edge may be considered to encompass not only the area specifically at the edge of a dresser, but may also include portions of the dresser which extend slightly inward from the actual edge. In one aspect, the leading edge may be located along an outer edge of the CMP pad dresser. In another aspect, the CMP pad dresser may be configured with a pattern of abrasive particles that provides at least one effective leading edge on a central or inner portion of the CMP pad dresser working surface. In other words, a central or inner portion of the dresser may be configured to provide a functional effect similar to that of a leading edge on the outer edge of the dresser.

As used herein, "euhedral" means idiomorphic, or having an unaltered natural shape containing natural crystallographic faces. In one aspect, diamond particles.

As used herein, "sharp portion" means any narrow apex to which a crystal may come, including but not limited to corners, ridges, edges, obelisks, and other protrusions.

As used herein, "metallic" means any type of metal, metal alloy, or mixture thereof, and specifically includes but is not limited to steel, iron, and stainless steel.

As used herein, "grid" means a pattern of lines forming multiple squares.

As used herein with respect to distances and sizes, "uniform" refers to dimensions that differ by less than about 75 total micrometers.

As used herein, "Ra" refers to a measure of the roughness of a surface as determined by the difference in height between a peak and a neighboring valley. Further, "Rmax" is a measure of surface roughness as determined by the difference in height between the highest peak on the surface and the lowest valley on the surface.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 micrometer to about 5 micrometers" should be interpreted to include not only the explicitly recited values of about 1 micrometer to about 5 micrometers, but also include individual values and sub-ranges within the indicated range. Thus, included in this numerical range are individual values such as 2, 3, and 4 and sub-ranges such as from 1–3, from 2–4, and from 3–5, etc. This same principle applies to ranges reciting only one numerical value. Furthermore, such an interpretation should apply regardless of the breadth of the range or the characteristics being described.

The Invention

Applicant has discovered devices and methods for improving the efficiency and quality of conditioning or dressing a CMP pad. By using the device to condition or dress a CMP pad, not only is the pad life extended, but also the constancy at which the pad may be used, and therefore, the speed at which the device accomplishes its work is improved.

Referring now to FIG. 1, there is shown a prior art CMP pad dresser 10, which has a plurality of abrasive particles 50 electroplated to a substrate 40. Electroplating material 60, is generally nickel precipitated out of an acid solution.

CMP pad dressers 10 using only the electroplating material 60 to attach the abrasive particles 50 to a substrate have many disadvantages that are apparent as shown in FIG. 1. First, the electroplating material is incapable of forming chemical bonds with the abrasive particles. Therefore, only weak mechanical forces hold the abrasive particles onto the substrate 40. When the pad dresser is rotated against a CMP pad, such mechanical forces are quickly overcome by the friction force acting on the abrasive particles. As a result the abrasive particles are easily loosened from the electroplating material, leaving voids in the electroplating material, such as spaces 70. Such voids are quickly filled with residue polished off of the work piece, as well as chemicals and abrasive particles from the slurry. These substances chemically attack and further weaken the electroplating material.

Because the mechanical forces created by the electroplating material 60 are the only means holding the abrasive particles 50 onto the substrate 40, exposure of the abrasive particles above the electroplating material must be kept to a minimum. Nevertheless, contact between electroplating material and the CMP pad is inevitable. Such contact wears the electroplating material and further facilitates the release of the abrasive particles. Additionally, during manufacture, the electroplating material tends to bubble up around the abrasive particles, in places such as convex portion 80. These convex portions, in addition to the already low exposure and tight spacing of the abrasive particles, make significant penetration of the abrasive particles into the CMP pad fibers difficult, if not impossible. Without such penetration, the effectiveness of the dressing process is handicapped.

Figure 2:
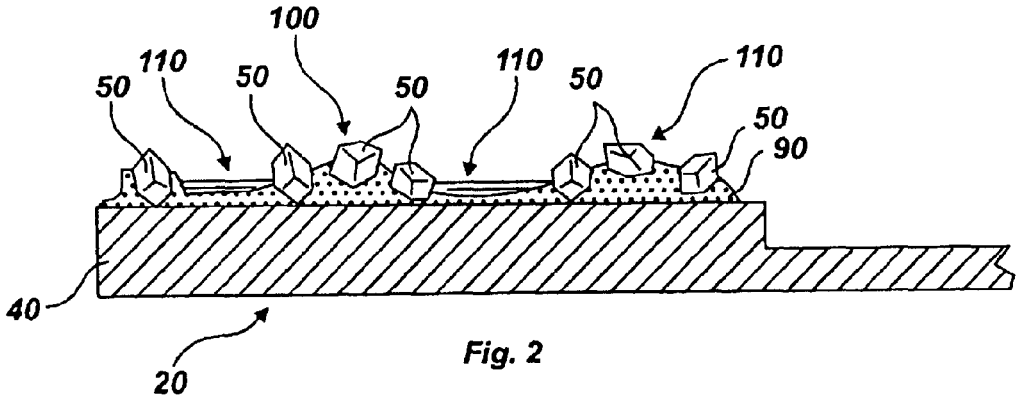
FIG. 2 is a side view of a prior art CMP pad dresser made by using a traditional brazing method for fixing the abrasive particles to the disk substrate.

Referring now to FIG. 2, there is shown a prior art CMP dresser pad 20 with a substrate 40, having abrasive particles 50, brazed to the substrate, using a brazing material 90, and conventional vacuum furnace brazing techniques. Brazing materials 90 generally comprise a metal alloy mixed with carbide formers. Such carbide formers allow the abrasive particles to chemically bond to the brazing material which in turn bonds with the substrate. This bonding arrangement significantly increases the overall strength of the CMP dresser, but is accompanied by some undesirable side effects.

Brazing material 90 must be kept to a minimum in order to avoid completely covering the abrasive particles 50. Therefore, the abrasive particles are wrapped in only a thin coating of brazing material. This problem is compounded by the fact that typical brazing materials are mechanically very weak. This mechanical weakness offsets the strength of the chemical bonds created between the abrasive particles and the brazing material. In fact, when dislodgment occurs, the chemical bonds between the abrasive particles and the brazing material are strong enough that the brazing material itself will often shear off along with detached abrasive particles.

The brazing material 90 is also very susceptible to chemical attack by the abrasive slurry. This contributes to the detachment of abrasive particles 50, as it further weakens the brazing material, which is already mechanically weak. Therefore, in order to reduce exposure of the CMP pad dresser 20 to the chemical slurry, polishing of the work piece must be paused, and the chemical slurry allowed to leave the pad before the pad dresser is applied. Such pauses in the polishing process greatly reduce the constancy with which the pad may be used, increase the time required to produce a finished product, and are therefore inefficient.

Another drawback to coupling the abrasive particles 50 to a substrate 40 by conventional brazing alone is that the surface tension of the molten metal alloy tends to cause the abrasive particles to "cluster" when applied to the substrate. Such clustering is illustrated at 100, leaving unintended gaps 110. The overall effect is a non-uniform distribution of abrasive particles, which makes grooming inefficient. Further, the gaps cause uneven conditioning of the pad, which ultimately wears out certain areas of the CMP pad faster than others, with the overall result that the work piece will receive an uneven polish because the worn out areas polish less effectively than the properly conditioned areas.

The clustering of abrasive particles creates another disadvantage by forming mounds in the brazing material 90. Mound formation raises some abrasive particles to a height above the substrate 40, which is greater than that of other abrasive particles. Therefore, the highest protruding abrasive particles may penetrate so deeply into the fibers of the CMP pad, that they will prevent lesser protruding abrasive particles from contacting the CMP pad or having a useful grooming effect.

Figure 3:
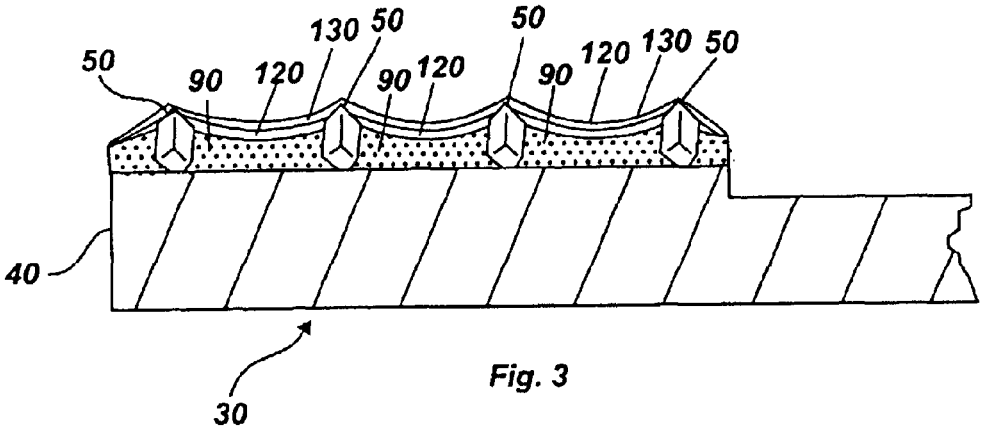
FIG. 3 is a side view of a CMP pad dresser made in accordance with one embodiment of the present invention.

In contrast to the CMP pad dressers of the prior art, the present invention allows even dressing of the CMP pad. Referring now to FIG. 3, there is shown a CMP pad dresser 30 made in accordance with the principles of the present invention. The CMP pad dresser has a plurality of abrasive particles 50 coupled to a substrate 40 with a brazing material 90.

Abrasive particles 50 may be of a variety of super hard materials. Examples of such materials include without limitation, diamond, polycrystalline diamond (PCD), cubic boron nitride (CBN) and polycrystalline cubic born nitride (PCBN).

Additionally shown in FIG. 3, is a layer of an overlay material 120, which is applied after the final brazing process. As recited above, the overlay provides a working surface that is substantially smoother than the working surface of the brazing alloy. Such smoothness and planarity provides a number of benefits, including reduced incidence of micro-scratching from flaking braze, and better bonding with the anti-corrosive layer when included. In one aspect, the working surface of the overlay material may have an Ra value of less than about 1 micrometer.

A number of suitable overlay materials may be used. However, in one aspect, the overlay materials include, without limitation, tin, nickel, tungsten, cobalt, chromium, and alloys thereof, such as a zirconium nickel alloy. The overlay material may be applied by a wide variety of methods. Examples of methods for applying the overlay material include without limitation, electroplating and physical vapor deposition (PVD). The layer of overlay material may be of any thickness required to achieve a specific result, but in one aspect of the invention the layer may have a thickness of from about 0.1 to 50 micrometers thick. In another aspect, the thickness of the overlay may be from about 0.1 to about 5 micrometers.

Further illustrated in FIG. 3, is an anti-corrosive layer 130. The optional anti-corrosive layer is formed over the surface of the CMP pad dresser after the abrasive particles 50 have been affixed to the substrate 40. In one aspect, the anti-corrosive layer may be a super abrasive material such as diamond-like carbon (DLC), or amorphous diamond. In one embodiment, the anti-corrosive layer has an atomic carbon content of at least about 80%. Additionally, while the anti-corrosive layer may have a variety of thicknesses as required to achieve a specific result, generally the thickness is in the range of 0.5 to 5 micrometers. In one aspect, the anti-corrosive layer has a thickness less than 3 micrometers. Such a thin anti-corrosive layer ensures that the working surface of the CMP pad dresser is protected without reducing the ability of the abrasive particles to dress the CMP pad. The anti-corrosive layer is generally produced by use of a physical vapor deposition (PVD) method. PVD methods such as the use of a cathodic arc with a graphite cathode, which is generally known in the art.

One advantage provided by the anti-corrosive layer 130, is that it effectively "seals" the working surface, and may also seal any other desired surfaces of the CMP pad dresser 30 that may be vulnerable to chemical attack. As a sealant, the anti-corrosive layer protects the brazing material 90 from chemical attack by the abrasive chemical slurry held within the CMP pad. This protection allows CMP pad dresser to dress a CMP pad in situ, and eliminates the production pauses used to prolong the useful life of prior art CMP pad dressers. The continual and even dressing of the CMP pad allows for greater production output, and prolongs the life and efficiency of the CMP pad.

While the anti-corrosive layer 130 may be used in some embodiments of the present invention, it is notable that the overlay material 120 has significant anti-corrosive characteristics in and of itself. As such, many of the production advantages may be obtained to a substantial degree, only when the overlay material is used, and without the use of the anti-corrosive layer.

Figure 4:
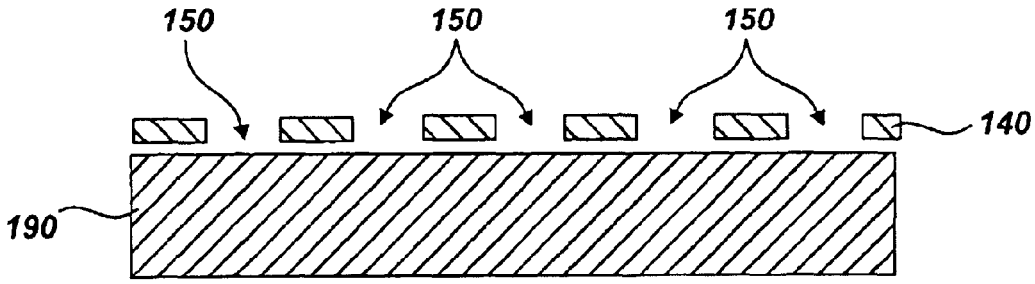
FIG. 4 is a side view of a sheet of brazing alloy with a template for placing abrasive particles on the surface thereof in accordance with one embodiment of the present invention.
Figure 5:
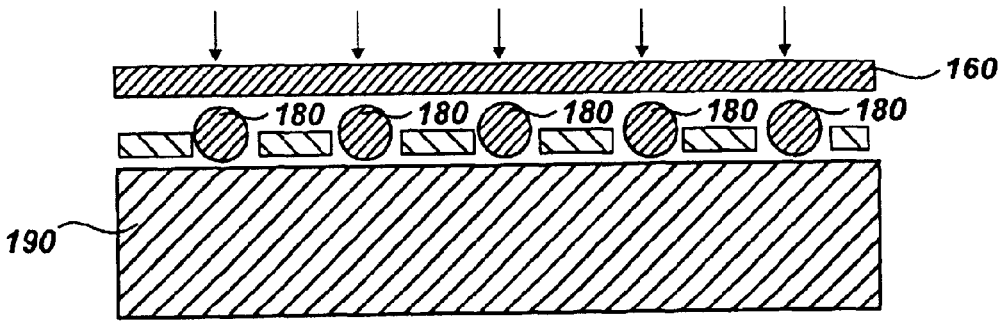
FIG. 5 is a side view of a sheet of brazing alloy with a template on its surface, and abrasive particles filling the apertures of the template. A flat surface is shown for use in pressing the abrasive particles into the sheet of brazing alloy in accordance with one embodiment of the present invention.
Figure 6:
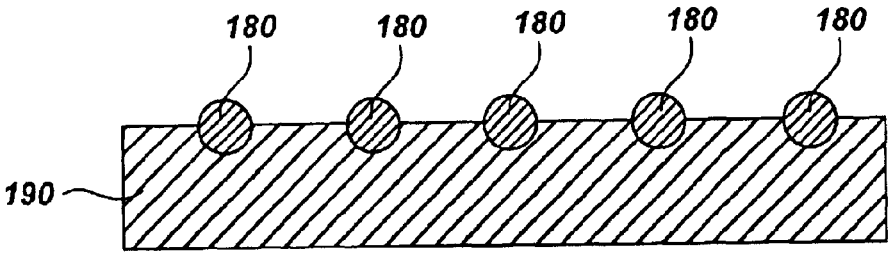
FIG. 6 is a side view of a sheet of brazing alloy having abrasive particles pressed into it in accordance with one embodiment of the present invention.

One method of affixing the abrasive particles 180 to a substrate is shown in FIGS. 4–6. First, a template 140 having apertures 150 is placed upon a sheet of brazing alloy 190. In one aspect of the present invention, the sheet may be a rolled sheet of continuous amorphous brazing alloy, as recited above. The use of the template allows controlled placement of each abrasive particle at a specific location by designing the template with apertures in a desired pattern.

After the template 140 is place on the brazing alloy sheet 190, the apertures 150 are filled with abrasive particles 180. The apertures have a predetermined size, so that only one abrasive particle will fit in each. Any size of abrasive particle, or grit is acceptable, however in one aspect of the invention, the particle sizes may be from about 100 to about 350 micrometers in diameter.

In another aspect of the invention, the size of the apertures in the template may be customized in order to obtain a pattern of abrasive particles having a size within a uniform in size range. In one embodiment, the apertures of the template are sufficient to select only grits within a size range having a variance no greater than 50 micrometers. This uniformity of grit size contributes to the uniformity of CMP pad grooming, as the workload of each abrasive particle is evenly distributed. In turn, the even workload distribution reduces the stress on individual abrasive particles, and extends the effective life of the CMP pad dresser.

After the apertures of the template 150 are all filled with grits 180, any excess abrasive particles are removed, and a flat surface 160 is applied to abrasive particles. The flat surface 160 must be of an extremely strong, rigid material, so that it is capable of pushing abrasive particles down into the brazing alloy sheet 190. Such materials typically include, but are not limited to steel, iron, alloys thereof, etc.

Abrasive particles 180 are shown to be embedded in brazing alloy sheet 190 in FIG. 6. Because surface 160 was flat, the abrasive particles will extend away from the substrate to a predetermined, uniform height. This uniform height will be determined by the thickness of template 140, and in a preferred embodiment, each abrasive particle will extend to within 50 micrometers of this distance. As such, each abrasive particle grooms to substantially the same depth on the CMP pad. However, it is to be understood that in certain applications, grit height may not be desired to be uniform. As such, those of ordinary skill in the art will recognize that grit patterns of varied height may be provided by so configuring the template, 140 and the surface 160 to provide such a design.

Abrasive particles 180 as shown in FIGS. 4–6 are rounded. However, in FIG. 3, they are pointed. The scope of the present invention encompasses abrasive particles of any shape, including euhedral, or naturally shaped particles. However, in one embodiment, the abrasive particles have a predetermined shape with a sharp point extending in a direction away from the substrate 40.

In an alternative embodiment, rather than pressing the abrasive particles 180 into the brazing alloy sheet 190, they may be fixed in the templated position by disposing an adhesive on the surface of the brazing alloy sheet. In this manner, the particles remain fixed in place when the template is removed, and during heat processing. In yet another embodiment of the invention, the template 140 may be laid upon a transfer sheet (not shown) having a thin adhesive film thereon. In this case, the particles become adhered to the transfer sheet using the template procedure specified above. The template is then removed, and the transfer sheet is laid onto the brazing sheet 190 with abrasive particles facing the sheet. Disposed upon the brazing sheet is the aforementioned adhesive layer, which is more strongly adhesive than the adhesive on the transfer sheet. Therefore, the abrasive particles are transferred to the sheet of brazing alloy in the pattern dictated by the template.

After the abrasive particles 180 are at least partially embedded in, or adhered to, the brazing alloy sheet 190, the sheet is affixed to the substrate 40 as shown in FIG. 3. Alternatively, in some embodiments, the sheet of brazing alloy may be first affixed to the substrate, and the abrasive particles subsequently added thereto using the template procedure described herein. The brazing alloy used may be any brazing material known in the art, but in one aspect, may be a nickel alloy that has a chromium content of at least 2% by weight. A brazing alloy of such a composition will be nearly super hard in and of itself, and less susceptible to chemical attack from the abrasive containing slurry. Therefore, the anti-corrosive layer 130, and the overlay material 120 are optional.

Because the abrasive particles 50 are firmly held in, or on the brazing alloy sheet 90, the surface tension of the liquid brazing alloy is insufficient to cause particle clustering as shown in FIG. 2. Additionally, braze thickening occurs to a much lesser degree and few or no "mounds" are formed. Rather, the braze forms a slightly concave surface between each abrasive particle, which provides additional structural support. In one embodiment, the thickness of the brazing alloy sheet 90 is predetermined to allow at least about 10 to 90% of each abrasive particle to protrude above the outer, or working, surface of brazing material 90. In another aspect, when the overlay material 120 is used, the abrasive particles may be selected or placed, so that at least about 10 to about 90% of each abrasive particle protrudes above the outer, or working, surface of the overlay material 120.

As a result of the methods for maintaining the abrasive particles 50 in a fixed position during processing, even spaces may be created between abrasive particles. Additionally, the abrasive grits may extend to a uniform height or distance above the substrate 40, which means when applied to a CMP pad, they will protrude to a uniform depth within the pad fibers. The even spacing and uniform protrusion causes the CMP to be dressed or groomed evenly, which in turn increases the polishing efficiency of the CMP pad and extends its useful life.

In addition to the specific methods of embedding, or adhering the abrasive particles to the brazing alloy, those skilled in the art will recognize suitable alternative procedures, such as fixing the abrasive particles to the substrate, and then placing the braze thereon. In this case, the particles may be positioned on the substrate using the template method recited above, and held in place by a glue, or other suitable binder. The braze material is then showered, or placed on the substrate around the abrasive particles, and the overlay material may be added.

Although the present invention encompasses a wide variety of patterns for abrasive particle placement which may be created using the method described above, one aspect of the present invention is the recognition of specific predetermined patterns that more adequately meet the particular needs and conditions for which CMP pad dressers are used. In order to accomplish such patterns, each grit is positioned and held at a specific location in accordance with the design of the pattern. Such patterns are indeed useful for achieving specific CMP pad dressing results, and may be varied in order to achieve a specific grooming result as will be seen.

For example, the grooming results of many known pads could be improved by placing grits in a certain configuration. Particularly, as CMP pads are flexible, the downward pressure exerted by the dresser causes the pad to rise or mound as it comes in contact with the leading edge of the dresser that is moving in a given direction. While the rising action may improve the dressing of the pad at the leading edge of the dresser as it allows a fuller contact with the abrasive particles, it may also cause a dipping action in the portion of the pad that has already passed under the leading edge of the dresser. Even if no dipping occurs, generally, the dressing action of the remaining portion of the dresser behind the leading edge is less effective than that of the leading edge (i.e. the first row of abrasive particles encountered by the pad as dictated by the directional movement of the dresser, or the spinning CMP pad, or both), because the pad is not allowed to rise again once underneath the dresser. As such, the majority of the dressing burden is placed on the abrasive particles at the leading edge of the dresser, and uneven particle wear occurs.

Therefore, in one aspect of the present invention, the pattern of abrasive particles may be configured to allow the CMP pad to rise while underneath the dresser at an interior or central location (i.e. a location that follows a leading edge), thus allowing them to be dressed by abrasive particles following those of the leading edge. In effect, such a configuration provides a multiplicity of leading edges along the working surface of the dresser. In this manner, the CMP pad is allowed to rise while under a central portion of the pad dresser, and increase dressing effectiveness. As will be seen, a variety of particle configurations or patterns can provide the required spacing of abrasive particles to achieve such actions and be used to achieve specifically desired dressing results.

Figure 7:
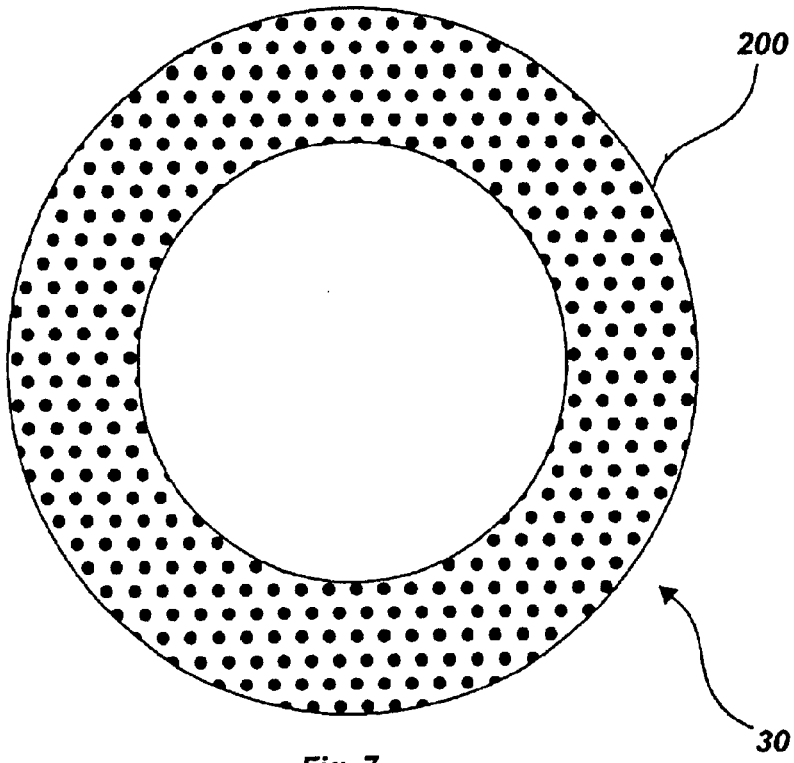
FIG. 7 is a top view of the working surface of a CMP pad dresser having abrasive particles coupled to the substrate such that abrasive particles present substantially only along the leading edge of the dresser, in accordance with one embodiment of the present invention.
Figure 8:
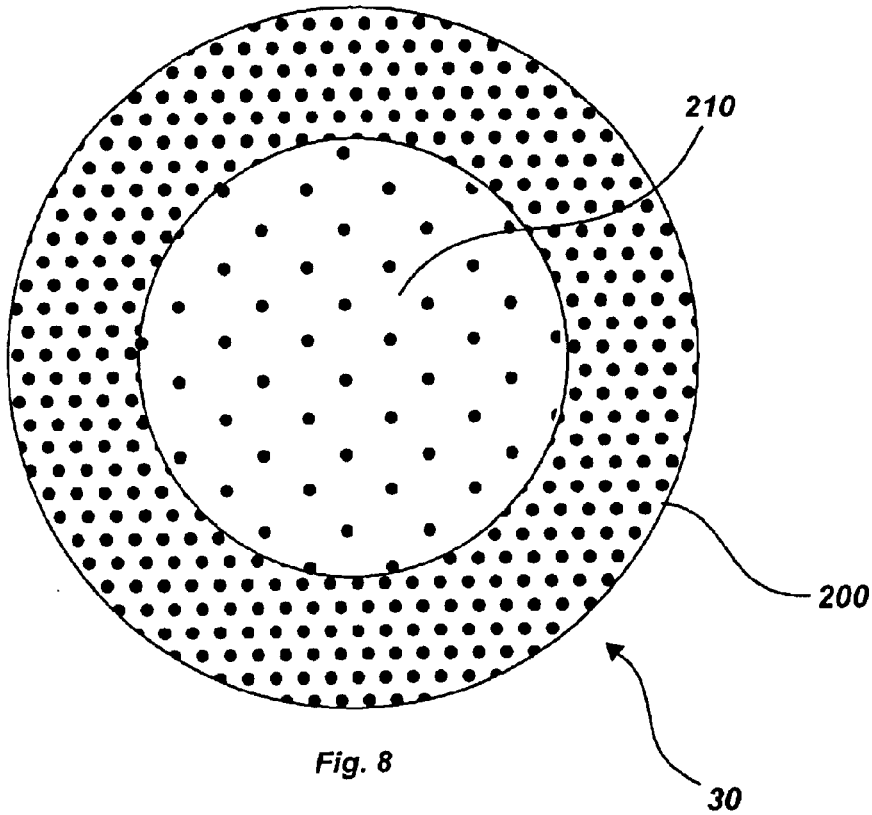
FIG. 8 is a top view of the working surface of a CMP pad dresser having abrasive particles coupled to the substrate such that more of the particles are at the leading edge than at the center, in accordance with one embodiment of the present invention.
Figure 9:
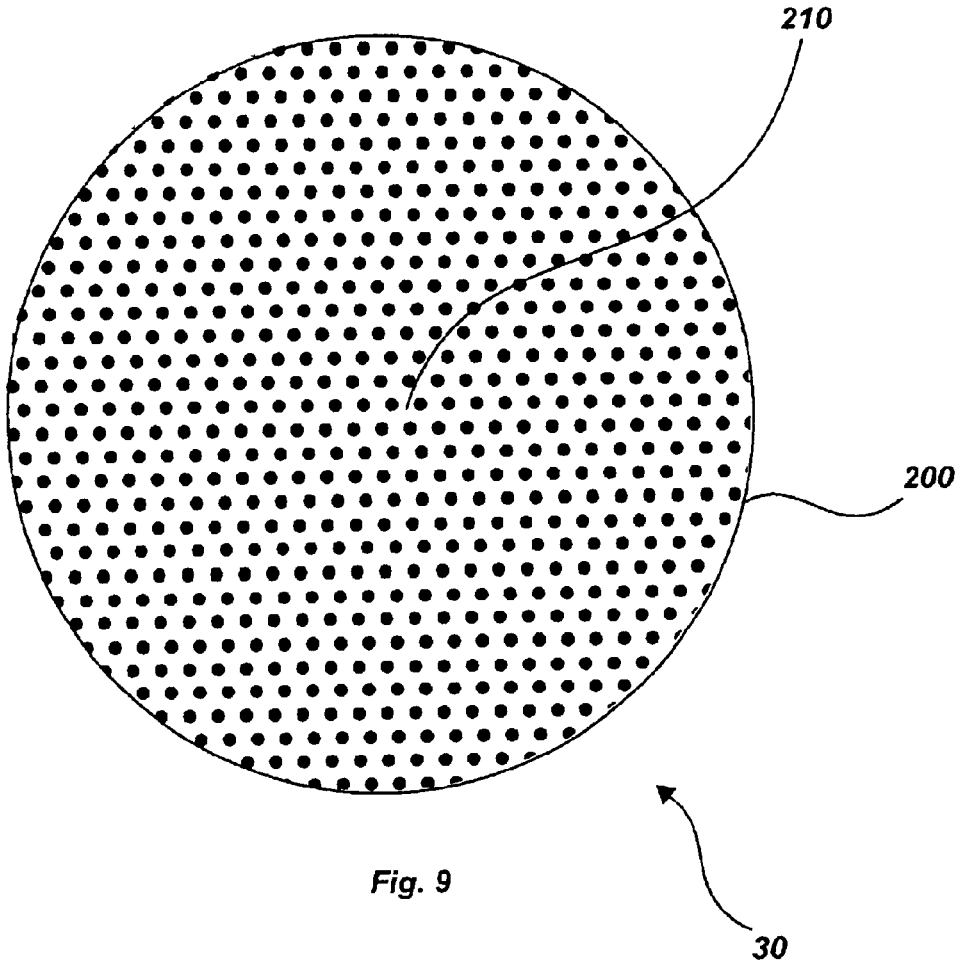
FIG. 9 is a top view of the working surface of a CMP pad dresser having abrasive particles coupled to the substrate such that the particles are uniformly distributed throughout, in accordance with one embodiment of the present invention.

As illustrated by way of example in FIG. 7, in one aspect of the invention, the abrasive particles may be arranged so as to have abrasive particles located only along the leading edge 200 of the pad dresser 30. Referring now to FIG. 8, in another aspect of the invention, the abrasive particles may be arranged to be more highly concentrated along the leading edge 200 than in the center 210. By contrast, in a further aspect of the invention, the abrasive particles may be arranged such that the abrasive particles are more concentrated in the center than along the leading edge (not illustrated). Referring now to FIG. 9, in yet another aspect of the invention, the abrasive particles may be arranged such that the they are uniformly distributed with a space between each particle that is sufficient to allow the afore-discussed pad rising. In one aspect, the uniformly distributed particles may form a grid and be evenly spaced at a distance of about 1.5 to about 10 times the size of each individual grit. As will be recognized by those skilled in the art, the abrasive particles may also be arranged in various concentration gradients increasing or decreasing in concentration from the leading edge toward the center of the CMP pad dresser (not illustrated).

Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

What is claimed is:

1. A chemical mechanical polishing (CMP) pad dresser comprising:

a substrate member; and a plurality of abrasive particles each coupled to the substrate member at a specific location in accordance with a predetermined pattern wherein said abrasive particles are coupled to the substrate member by a brazing alloy comprising a nickel alloy having a chromium amount of at least about 2 wt %.

2. The CMP pad dresser of claim 1, wherein said substrate member is made of a metallic material.

3. The CMP pad dresser of claim 2, wherein said metallic material is stainless steel.

4. The CMP pad dresser of claim 1, wherein said substrate member comprises a brazing alloy.

5. The CMP pad dresser of claim 1, wherein said abrasive particles are super abrasive particles.

6. The CMP pad dresser of claim 5, wherein said super abrasive particles are selected from diamond, polycrystalline diamond (PCD), cubic boron nitride (cBN), and polycrystalline cubic boron nitride (PCBN).

7. The CMP pad dresser of claim 5, wherein said super abrasive particles are diamond.

8. The CMP pad dresser of claim 1, wherein said abrasive particles have a predetermined shape.

9. The CMP pad dresser of claim 8, wherein the predetermined shape is a selected euhedral shape.

10. The CMP pad dresser of claim 8, wherein said abrasive particles have a sharp portion oriented away from the substrate member.

11. The CMP pad dresser of claim 1, wherein said abrasive particles have a size within a uniform size range.

12. The CMP pad dresser of claim 1, wherein said abrasive particles have a size from about 100 to 350 micrometers.

13. The CMP pad dresser of claim 12, wherein said uniform size range has a variance of no greater than 50 micrometers.

14. The CMP pad dresser of claim 1, wherein the predetermined pattern of the abrasive particles is configured to facilitate a rise in a portion of a pad passing underneath the CMP pad dresser.

15. The CMP pad dresser of claim 14, wherein the configuration of said predetermined pattern imparts at least one effective leading edge to an interior portion of the dresser.

16. The CMP pad dresser of claim 15, wherein the predetermined pattern is a grid.

17. The CMP pad dresser of claim 15, wherein the predetermined pattern consists of abrasive particles positioned substantially along an exterior edge of the dresser.

18. The CMP pad dresser of claim 15, wherein the predetermined pattern comprises an exterior portion concentration of abrasive particles that is higher than an interior portion concentration of abrasive particles.

19. The CMP pad dresser of claim 1, wherein said predetermined pattern of the abrasive particles is configured such that a uniform, predetermined distance is maintained between any two abrasive particles.

20. The CMP pad dresser of claim 19, wherein said predetermined distance is from about 1.5 to about 10 times the size of the individual particles.

21. The CMP pad dresser of claim 1, wherein said abrasive particles extend to a predetermined height above the substrate member.

22. The CMP pad dresser of claim 21, wherein said predetermined height above the substrate is a uniform height to which all abrasive particles extend above the substrate member.

23. The CMP pad dresser of claim 1, wherein the brazing alloy is a layer having a predetermined thickness.

24. The CMP pad dresser of claim 23, wherein the brazing alloy layer is an amorphous braze film.

25. The CMP pad dresser of claim 23, wherein the thickness of the layer of brazing alloy is such that between about 10–90% of each abrasive particle is exposed.

26. The CMP pad dresser of claim 1, wherein the brazing alloy is sprayed onto the substrate as a slurry.

27. The CMP pad dresser of claim 1, wherein the CMP pad dresser is coated with an anti-corrosive layer.

28. The CMP pad dresser of claim 27, where the anti-corrosive layer has a thickness of less than about 3 micrometers.

29. A chemical mechanical polishing (CMP) pad dresser comprising:

a substrate member;

a plurality of abrasive particles each coupled to the substrate member by brazing with a brazing alloy at a specific location in accordance with a predetermined pattern; and an overlay material having a working surface that is smoother than a working surface of the brazing alloy.

30. The CMP pad dresser of claim 29, wherein the overlay material is deposited as a layer having a predetermined thickness.

31. The CMP pad dresser of claim 30, wherein the predetermined thickness of the layer of overlay material is from about 0.1 to 50 micrometers.

32. The CMP pad dresser of claim 29, wherein the overlay material includes a member selected from the group consisting essentially of titanium, nickel, tungsten, cobalt, chromium, zirconium, and alloys thereof.

33. The CMP pad dresser of claim 32, wherein the overlay material comprises a zirconium nickel alloy.

34. The CMP pad dresser of claim 29, wherein the overlay material is applied by electrodeposition.

35. The CMP pad dresser of claim 29, wherein the overlay material is applied by physical vapor deposition (PVD).

36. A method of reducing flaking in a CMP pad dresser having a plurality of abrasive particles coupled to a brazing layer comprising the steps of:

applying a layer of an overlay material to the brazing layer said overlay material having working surface that is smoother than a working surface of the brazing layer.

* * * * *